US005667221A

United States Patent [19]

Lièvre

[11] Patent Number: 5,667,221

[45] Date of Patent: Sep. 16, 1997

[54] TUBULAR PUZZLE OR TOY WITH ROLLING MEMBERS

[76] Inventor: Martin René Lièvre, RR #3, Thedford, Ontario, Canada, N0M 2N0

[21] Appl. No.: 490,431

[22] Filed: Jun. 14, 1995

[51] Int. Cl.[6] ..... A63F 9/06

[52] U.S. Cl. ..... 273/153 R; 273/109

[58] Field of Search ..... 273/153 R, 154, 273/440, 123 R, 109, 110, 113

[56] References Cited

U.S. PATENT DOCUMENTS

| | | | |
|---|---|---|---|
| 589,825 | 9/1897 | Gephart | 273/123 R |
| 598,879 | 2/1898 | Sutherland | 273/123 R |
| 601,924 | 4/1898 | Wilson | 273/153 R |
| 1,765,019 | 6/1930 | Maxwell | 273/153 R |
| 2,553,913 | 5/1951 | Gleasman | 273/109 |
| 3,738,658 | 6/1973 | Smith | 273/109 |
| 4,909,512 | 3/1990 | Davis | 273/153 R |

*Primary Examiner*—Steven B. Wong

[57] ABSTRACT

In this invention two similar bearings or balls are contained within a sealed tubular capsule. The capsule is comprised of a fully transparent material of a singular rigid substance. The capsule is composed of a lengthier playing field and two shorter storage compartments or traps. Each trap is situated at opposite ends of the playing field and accessed by each ball via an orifice of particular configuration. The configuration is such that the slope of the capsule wall leading out of the trap is at a greater angle to the longitudinal axis than the slope of the capsule wall leading into the trap is to the longitudinal axis. The objective of the game is to get a ball into each trap.

4 Claims, 1 Drawing Sheet

TUBULAR PUZZLE OR TOY WITH ROLLING MEMBERS

BACKGROUND OF THE INVENTION

1. Field of the Invention

This invention relates to an amusement device. More specifically, this invention relates to a puzzle or toy consisting of a tubular multi-chambered capsule and two rolling members requiring separate positioning into the outer chambers.

2. Background Art

Puzzles and toys are created to challenge and test mankind's dexterity and/or intellect. The articles found in the market place attest to the diversity and ingenuity displayed. Products reflecting those ideas are at times cumbersome and often laborious. Simplicity is overlooked both in design and fabrication resulting in additional external parts being subject to misplacement and additional assembly pieces. Although some puzzles and toys provide a manipulation problem, the manipulation primarily consists of simply manipulating ball(s) through a maze by manual dexterity. Only one prior invention employed the use of momentum in the form of centrifugal force as a solution; however, the design is complex requiring construction of sides, cover, and curved base with depressions and recesses. Simplification of design and fabrication for entirely self-contained amusement devices which enhances or will not jeopardize the challenge of the devices' solution or manipulation are valued improvements in the art.

None of the prior inventions are adapted for the manipulation of balls whereby features added to create a challenging feat of manipulation form an integral part of and are incorporated as the enclosure or capsule itself in which the balls are encased. This is due to the fact that prior inventions append features to an enclosure resulting in the production of troughs, grooves, crevices, holes, depressions, recesses, projecting barriers and barricades, and separate covers and sides for encasement and these inventions are the enclosure being the feature or extraneous feature. These prior inventions are incapable of claiming and are not conducive to easy fabrication and to reducing manufacturing and production costs while still providing an extremely challenging amusement device.

Also, prior puzzle/toys require movement of balls induced by specific motion, they do not address a broad spectrum of skill in the art utilizing the combined manipulation of the device via vertical and horizontal rotation or a combination thereof, balancing, tapping and uni or bi directional spinning as a solution to the placement of rolling members or balls contained within a consecutively linked multi-chambered fully symmetrical capsule and still maintain itself as a simply designed unit. Unfortunately, there is a tradeoff between fabrication complexity and manipulation requirements for a puzzle/toy device; both aspects are contradictory characteristics. Although, manipulation requirements could be increased for this invention which would accommodate all above-noted manipulation with the insertion of two simple internal partitions, these partitions would not aid in augmenting the simplicity of design and fabrication sought for a puzzle/toy device.

The following patents are listed as pertinent art found:

| PATENT NO | INVENTOR | TITLE |
|---|---|---|
| 4,909,512 | Davis | "Game Apparatus Utilizing Rolling Members" |
| 3,738,658 | Smith | "Disk Rotating Game" |
| 2,553,913 | Gleasman | "Puzzle" |
| 1,765,019 | Maxwell | "Ball Puzzle Device" |
| 601,924 | Wilson | "Toy or Puzzle" |
| 598,879 | Sutherland | "Game Apparatus" |
| 589,825 | Gephart | "Game Board" |

SUMMARY OF THE PRESENT INVENTION

This invention relates to a manually operable puzzle/toy for personal challenge and enjoyment or recreational pleasure and pertains to certain improvements in the art.

What is provided is a tubular capsule. The tubular capsule is fully transparent and is made up of a number of inner chambers. The inner chambers are consecutively linked and require the positioning of two rolling members or balls into separate chambers or compartments located at opposite ends.

The present invention overcomes the difficulty of establishing a puzzle/toy device for the purpose of maintaining challenging ball manipulation and challenging solution solving utilizing the fewest number of parts, pieces and appurtenances. Any manner of device manipulation may have been adopted; however, it is centrifugal force that is best suited to the symmetrically circular shape of this invention which results in its simplicity of design and fabrication. The low and flat profile created by the tubular shape of the capsule or enclosure enhances the user's belief that each ball could be separately isolated via tilting.

A significant aspect of this invention is that the design and thereby fabrication embodies a different principle than previously known devices of this character. Unique to this puzzle/toy is the structure of the wall that forms the tubular capsule. The wall is of singular construction and forms a smooth, continuous enclosure void of any grooves, holes, recesses or similar irregularities to facilitate cost efficient mass production. It is this wall structure that directly controls the movement of a minimal quantity of balls and serves as an enclosure rather than a wall structure functioning as a means to attach appurtenant features or contain a large number of balls which would control device manipulation.

Further aspects of this invention is the concept and creation for production purposes of an amusement device which aside from a small quantity of rolling members has no separate or extra elements or appendages loose, fused or otherwise attached to serve a function internally or externally; hence, of simple construction and readily manufactured yet still challenging in concept and use. Creation of internal portals and passageways utilizing a single enclosed shell completely symmetric about a central axis.

Applicant wishes to entitle the device as "Raptor", named after the family's pet horse, premised on the battles and difficulties associated with relocating from home to home attributed to economic uncertainties the past several years.

BRIEF DESCRIPTION OF THE DRAWINGS

A thorough understanding of the device and its internal objects in conjunction with their associated functions will result from the following description and appended drawings, wherein.

DETAILED DESCRIPTION OF THE PREFERRED EMBODIMENT

Figure 3:
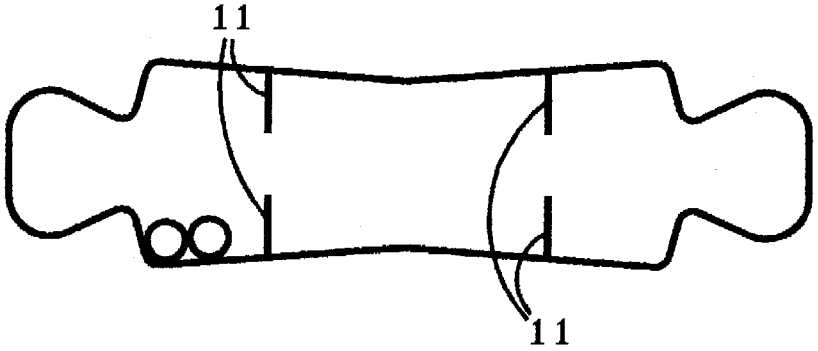
FIG. 3 is an alternative embodiment of this invention.
Figure 2:
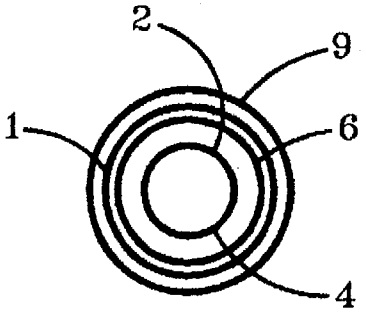
FIG. 2 is a side view representing the end of the device shown in FIG. 1.
Figure 1:
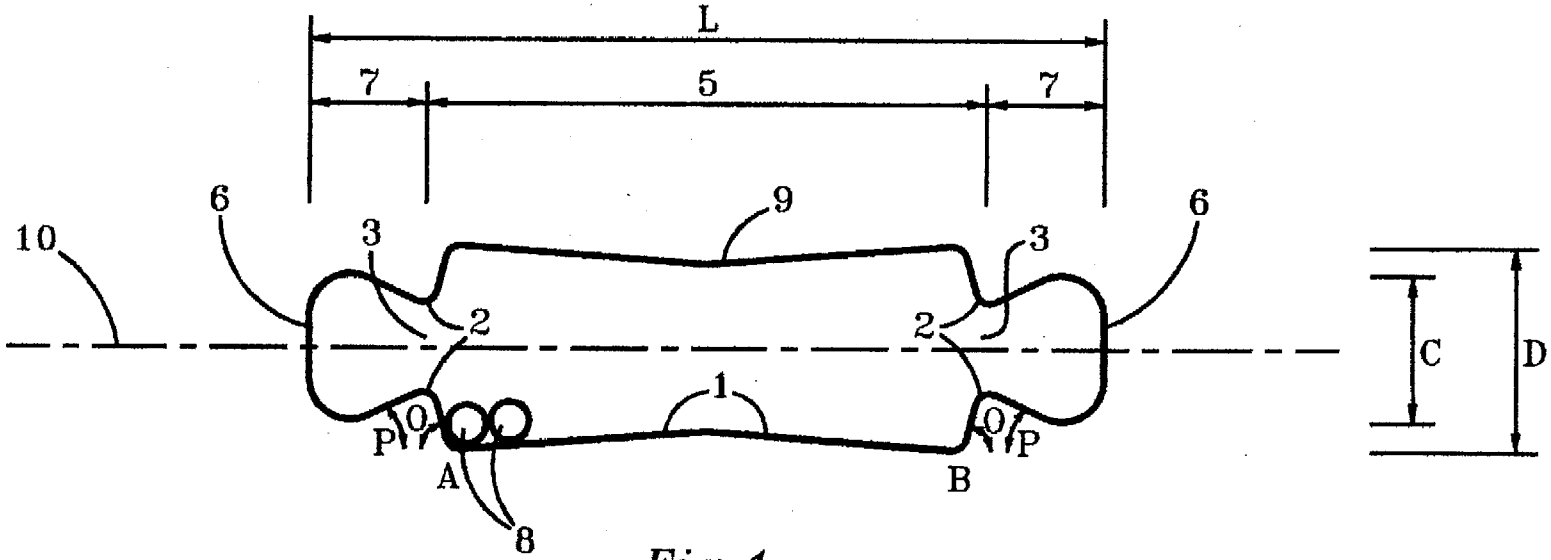
FIG. 1, due to the devices symmetry, is both plan view and profile view of this invention.

Embodiments of this invention are illustrated in FIGS. 1–3. The section of the capsule spanning between each orifice (3) and orifice wall (4) shall be termed as the playing field (5). The storage compartments which are bounded by the outer trap walls (6) and extend from an orifice to the end of the capsule shall be termed as a trap (7).

The capsule shall be of a transparent rigid material (clear glass or plastic) for visual interaction. No limitations are placed on the overall length (L), size, or dimensions of the capsule; however, ideal sizing shall be such to permit manual manipulation by the user's hands.

There can be diversity in the shape and configuration of the capsule. Other than for practicality, the cross-sectional area of the capsule isn't restricted to being circular in nature. Note that a circle constitutes a single condition of an ellipse. The central section of the capsule may be constructed of a smaller diameter than that at points (A) & (B) (ie. playing field bowed radially inward) to facilitate separation of the balls (8) which are contained within the capsule. A plurality of balls (8) are similar.

Each orifice is configured with a steeper angle into the playing field (O) and a flatter angle into the trap (P), e.g. O=75°, P=25°. Both slopes forming part of the capsule wall of each orifice are oppositely inclined with the slope leading into the trap having a greater angle to the longitudinal central axis (10) than the slope inside the trap having to the longitudinal central axis. Due to this slope differential, if one ball is contained within a trap, any attempts to move (by rocking) the second ball into a second trap will not occur until after the trapped ball has reentered the playing field.

The diameter of the orifices shall be large enough to permit easy passage of the balls (8) between the playing field and each trap. The angular transition forming the outer capsule wall of each orifice should be rounded (2) and the orifices of sufficient size to enhance unobstructed movement of the balls exiting each trap into the playing field.

The diameter of the traps (C) could be smaller than the diameter of the playing field (D) and the flatter angle (P) and its associated wall length for each trap could be further reduced to ensure that the balls would not be trapped apart at opposite ends using this rocking motion.

The playing field can be kept very simple as an unimpeded conical surface bowed radially ranging towards or away from the longitudinal central axis (10) or can be more complex comprised of barriers and corridors as found in conventional maze type puzzles.

It must be emphasized that the playing field wall (9) if obstructed by a complex network of barriers and partitions 11 e.t.c. may require to be constructed on inclined planes, as depicted by lines (1), so as not to make the separation of the balls to points (A) & (B) impossible.

The intention of the maze within the playing field is not only to create a personal challenge in separating the balls but also to establish and instill a one-way train of thought in moving the balls around which will then be continued in attempts to place the balls from points (A) & (B) into their respective traps.

The only direct resolution to the puzzle/toy is to apply centrifugal force in a singular plane (preferably horizontal) to the balls by spinning. The two balls would be propelled away from the mid point of the capsule indefinitely outward to be contained by the storage compartments at each end of the capsule.

Furthermore, additional compartments placed within a maze or a string of orifices could be oriented such that only spinning the normally hand held object would permit onward simultaneous progression of the balls to their final destinations.

I claim:

1. A manually operable puzzle/toy device comprising:

a. a completely enclosed tubular transparent confinement capsule entirely symmetrically shaped about its longitudinal central axis;

b. a plurality of freely moving balls, each shaped similarly, contained within the confinement capsule;

c. a plurality of orifices, each shaped similarly, forming part of the capsule wall and positioned towards each end of the confinement capsule, thereby creating a trap for the balls;

d. said orifices specifically constructed such that the capsule wall leading into the trap is steeper or at a greater angle to the longitudinal axis than the capsule wall inside the trap, such that a ball inside the trap situated at one end of the capsule would escape the trap if the device were tilted in attempts to roll another ball into another trap situated at another end of the capsule;

e. said balls which can propagate in opposite directions simultaneously along a single plane that passes through the device's longitudinal central axis due to any single or plurality of spin direction(s) for the device;

f. said confinement capsule in which a single continuous enclosed capsule wall or shell serves a dual purpose by functioning as containment envelope and by providing a complex configuration in retarding or controlling the movement of said balls within.

2. The manually operable puzzle/toy device of claim 1 wherein the capsule wall forms a smooth rounded angular transition longitudinally for each circular orifice.

3. The manually operable puzzle/toy device of claim 1 wherein the plurality of traps formed by the capsule wall have a greatest diameter which is smaller than the diameter of the capsule wall at the base of and located between each orifice.

4. The manually operable puzzle/toy device of claim 1 wherein the capsule includes a plurality of partitions which define a plurality of compartments linked in a consecutive arrangement along the longitudinal central axis.

* * * * *

UNITED STATES PATENT AND TRADEMARK OFFICE

CERTIFICATE OF CORRECTION

PATENT NO. : 5,667,221

DATED : December 12, 1996

INVENTOR(S) : Martin René Lièvre

It is certified that error appears in the above-indentified patent and that said Letters Patent is hereby corrected as shown below:

Column 1, line 43, insert " consequently of awkward and/or bulky construction. In other words the enclosure for prior amusement devices involving the propagation of the balls have extraneous features added to the enclosure as distinct from" after -- for encasement and these inventions are --.

Column 3, line 59, change --11-- to read "(11)".

Signed and Sealed this

Seventh Day of July, 1998

Bruce Lehman

*Attest:*

BRUCE LEHMAN

*Attesting Officer*

*Commissioner of Patents and Trademarks*